US009583870B2

(12) United States Patent
Motohashi et al.

(10) Patent No.: US 9,583,870 B2
(45) Date of Patent: Feb. 28, 2017

(54) CONNECTOR FOR PREVENTING FORCE TRANSMISSION

(71) Applicant: Yazaki Corporation, Tokyo (JP)

(72) Inventors: Yuuichirou Motohashi, Shizuoka (JP); Takaaki Miyajima, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/065,216

(22) Filed: Mar. 9, 2016

(65) Prior Publication Data

US 2016/0276776 A1 Sep. 22, 2016

(30) Foreign Application Priority Data

Mar. 18, 2015 (JP) ..... 2015-054354

(51) Int. Cl.
*H01R 13/58* (2006.01)
*H01R 13/56* (2006.01)

(52) U.S. Cl.
CPC ..... *H01R 13/5812* (2013.01); *H01R 13/5808* (2013.01); *H01R 13/562* (2013.01)

(58) Field of Classification Search
CPC ..... H01R 13/562
USPC ..... 439/474
See application file for complete search history.

(56) References Cited

U.S. PATENT DOCUMENTS 5,624,269 A * 4/1997 Kanamori ..... H01R 9/091 439/474
7,867,016 B2 * 1/2011 Nabilek ..... H01R 12/585 439/474

FOREIGN PATENT DOCUMENTS

JP 2014-11134 A 1/2014
WO 2014/007197 A1 1/2014

* cited by examiner

*Primary Examiner* — Tho D Ta
(74) *Attorney, Agent, or Firm* — Sughrue Mion, PLLC

(57) ABSTRACT

A connector includes: a casing; a terminal which is connected to a mating terminal; a flexible conductor disposed inside the casing and on a side opposite to the mating terminal with respect to the terminal, and electrically connected to the terminal; a connecting member which is a conductor fixed to the casing, is disposed on a side opposite to the terminal with respect to the flexible conductor, and is electrically connected to the flexible conductor; and an electrical wire which is disposed on a side opposite to the terminal with respect to the connecting member, is electrically connected to the connecting member, and is drawn from the casing in a direction opposite to an insertion direction of the terminal toward the mating terminal.

11 Claims, 4 Drawing Sheets

CONNECTOR FOR PREVENTING FORCE TRANSMISSION

CROSS-REFERENCE TO RELATED APPLICATION(S)

The present application claims priority to and incorporates by reference the entire contents of Japanese Patent Application No. 2015-054354 filed in Japan on Mar. 18, 2015.

BACKGROUND OF THE INVENTION

1. Field of the Invention

The present invention relates to a connector.

2. Description of the Related Art

Hitherto, a connector to which an electrical wire used for power supply or communication of a control signal or the like is connected is known. For example, Japanese Patent Application Laid-open No. 2014-11134 mentioned below discloses an L-shaped connector which includes a housing (casing), a terminal held in the housing, a flexible conductor which extends in an opposite direction of an insertion direction of the terminal toward a mating terminal, an electrical wire which is drawn from the inside of the housing toward the outside in a direction perpendicular to the insertion direction, and a weld portion which welds an end portion of the flexible conductor on the extension side and the electrical wire to each other.

Incidentally, in a case where the connector is mounted in a movable object such as a vehicle, an external force due to the movement is exerted on the electrical wire, and a force that occurs in the electrical wire is transmitted to the terminal. Therefore, there is a possibility that failure of the contact between the terminal and the mating terminal may occur. Here, in the L-shaped connector of Japanese Patent Application Laid-open No. 2014-11134, the force that occurs in the electrical wire is absorbed by the flexible conductor and thus the transmission of the force to the terminal is prevented. Furthermore, in the L-shaped connector, the weld portion between the flexible conductor and the electrical wire is screwed to the housing, and thus the transmission of the force from the electrical wire to the terminal is prevented. However, the structure for preventing the transmission of the force is applicable to the L-shaped connector, and it is difficult to apply the structure to a straight type connector as it is. Therefore, regarding a structure for preventing the transmission of a force in the straight type connector, there is still room for improvement. The straight type connector is a connector in which an insertion direction between a terminal in a casing and a mating terminal and a drawing direction of an electrical wire from the inside of the casing are coincident with each other.

SUMMARY OF THE INVENTION

Therefore, an object of the present invention is to provide a connector capable of suppressing the transmission of a force from an electrical wire to a terminal.

In order to achieve the above mentioned object, a connector according to one aspect of the present invention includes a casing having insulation properties; a terminal which is accommodated and held on an inside of the casing and is connected to a mating terminal in a connector connection state; a flexible conductor which is a conductor having flexibility, is disposed inside the casing and on a side opposite to the mating terminal with respect to the terminal, and is electrically connected to the terminal; a connecting member which is a conductor fixed to the casing in the casing, is disposed on a side opposite to the terminal with respect to the flexible conductor, and is electrically connected to the flexible conductor; and an electrical wire which is disposed on a side opposite to the terminal with respect to the connecting member, is electrically connected to the connecting member, and is drawn from the inside of the casing in a direction opposite to an insertion direction of the terminal toward the mating terminal.

According to another aspect of the present invention, in the connector, it is possible to configure that the connecting member includes a fixing portion which protrudes in a direction intersecting the insertion direction, and is fixed to the casing via the fixing portion.

According to still another aspect of the present invention, in the connector, it is possible to configure that the flexible conductor includes a bent portion which is bent in the direction intersecting the insertion direction.

According to still another aspect of the present invention, in the connector, it is possible to configure that the connector further includes an electrical wire holding mechanism which holds a portion of the electrical wire on the drawing direction side with respect to a portion of the electrical wire connected to the connecting member.

According to still another aspect of the present invention, in the connector, it is possible to configure that the connecting member includes an electrical connection portion which electrically connects the flexible conductor to a core of the electrical wire.

According to still another aspect of the present invention, in the connector, it is possible to configure that the connector further includes a shield structure which covers the casing from an outside and is configured to prevent intrusion of radio waves from the outside into the inside of the casing.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an embodiment of a connector according to the present invention will be described in detail with reference to the drawings. The invention is not limited by the embodiment.

Embodiment

One of embodiments of the connector (hereinafter, simply referred to as "connector") according to the present invention will be described with reference to FIGS. 1 to 4. For the convenience of illustration, a specific pattern (stitch) of braid 73 is omitted.

Figure 1:
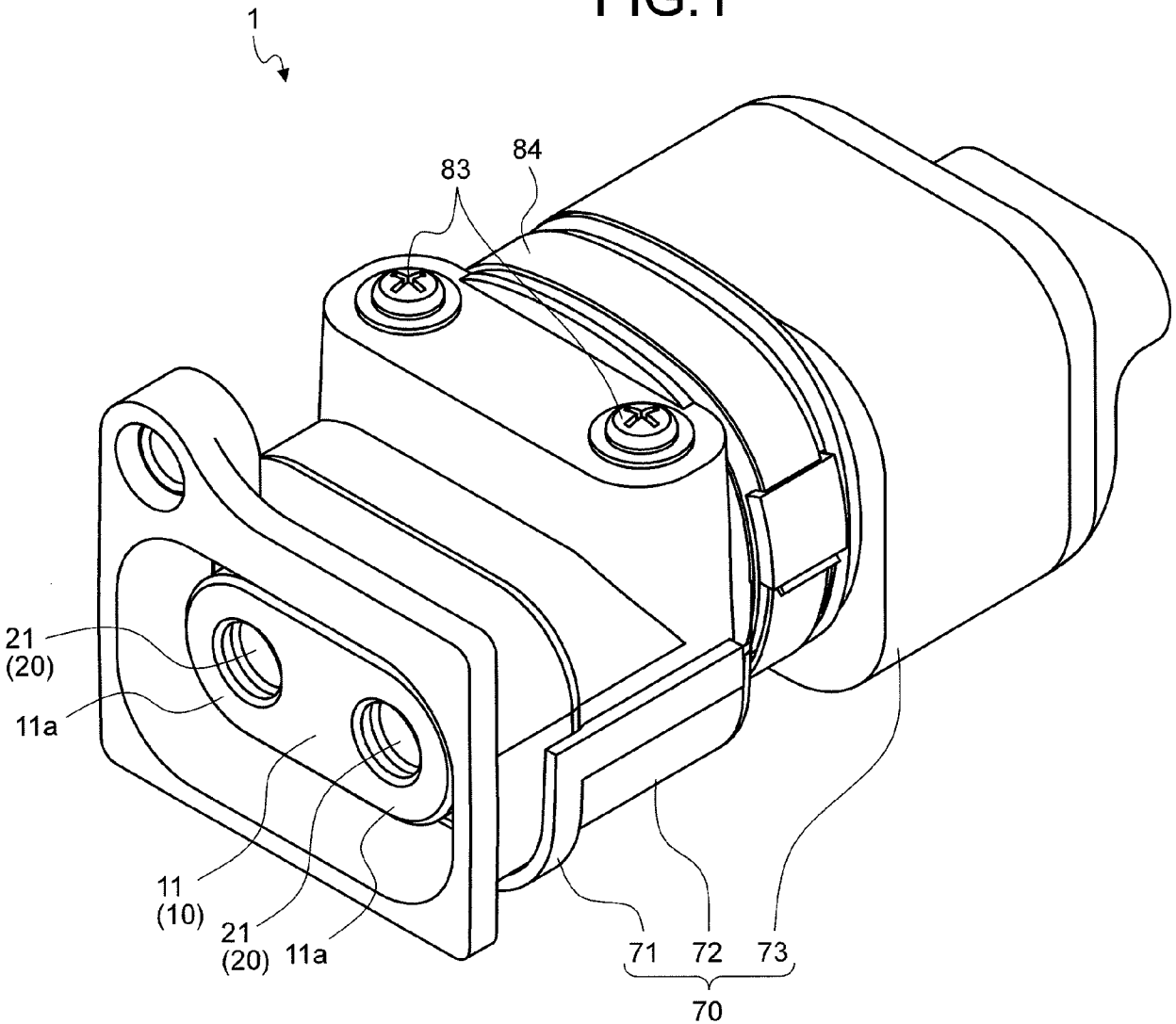
FIG. 1 is a perspective view illustrating a connector of an embodiment.
Figure 2:
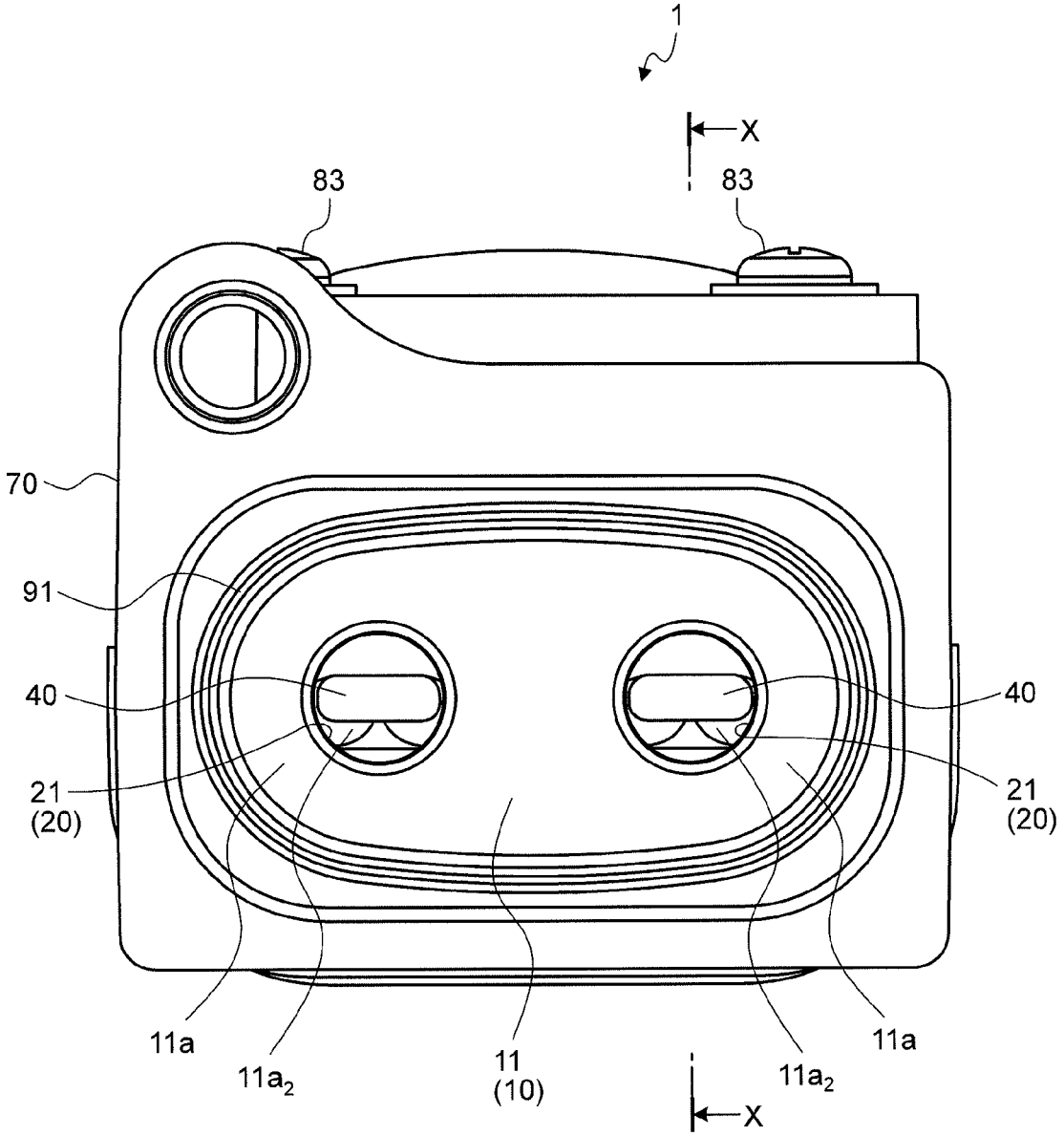
FIG. 2 is a front view illustrating the connector of the embodiment.
Figure 3:
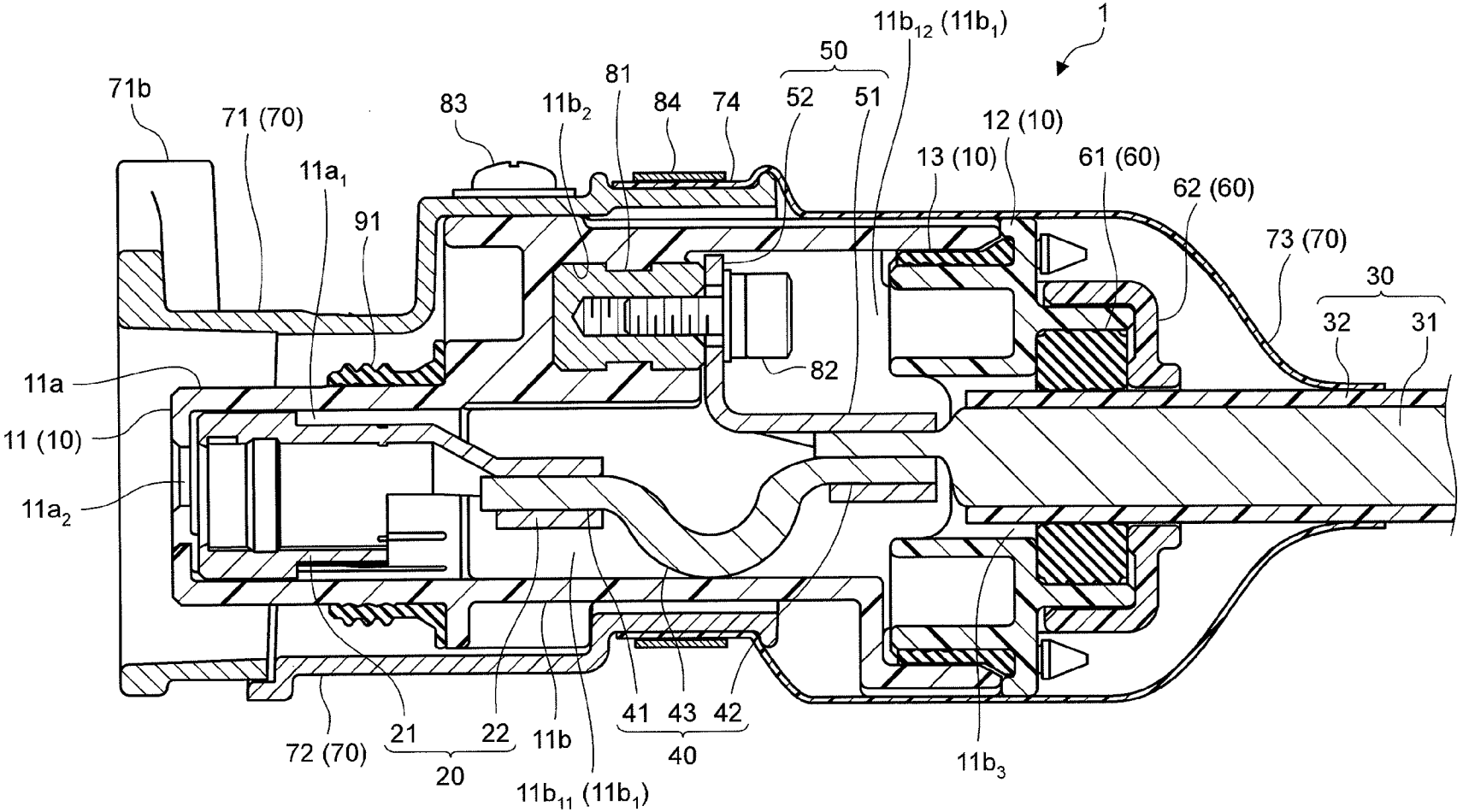
FIG. 3 is a sectional view taken along line X-X of FIG. 2.
Figure 4:
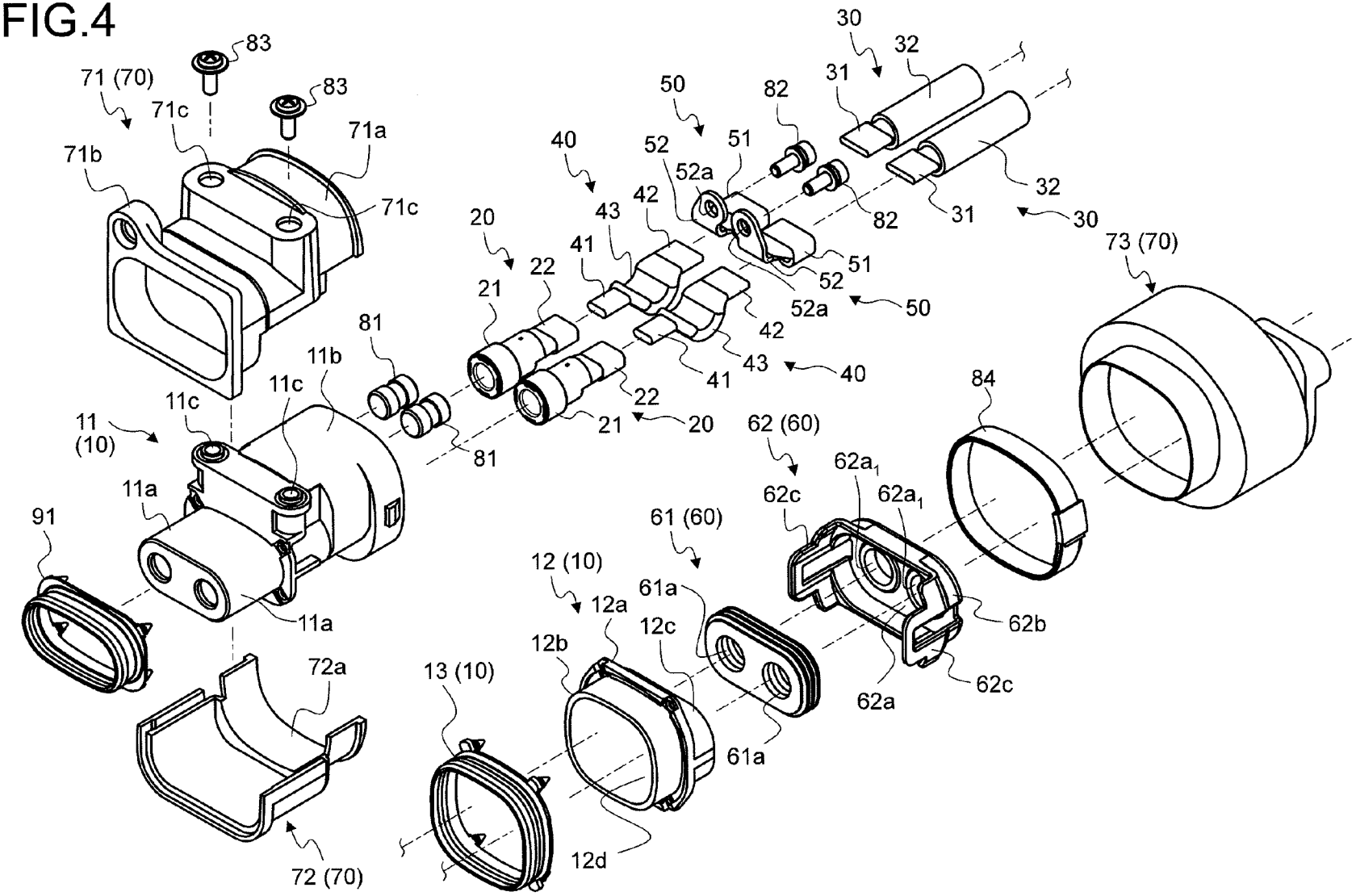
FIG. 4 is a deployment perspective view illustrating constituent components of the connector of the embodiment.

Reference numeral 1 in each of the drawings denotes the connector of this embodiment. As illustrated in FIGS. 3 and 4, the connector 1 includes a casing 10, terminals 20, electrical wires 30, flexible conductors 40, connecting members 50, an electrical wire holding mechanism 60, and a shield structure 70. The flexible conductors 40, the connecting members 50, and the electrical wire holding mechanism 60 constitute an external force transmission suppressing mechanism which suppresses the transmission of a force from the electrical wire 30 to the terminal 20. In the connector 1, by electrically connecting the terminal 20, the electrical wire 30, the flexible conductor 40, and the connecting member 50 as described later, an electrical wire with a terminal is formed.

The casing 10 accommodates the terminals 20, ends of the electrical wires 30, the flexible conductors 40, and the connecting members 50 therein and is covered by the shield structure 70 from the outside. The casing 10 has insulation properties. The casing 10 includes a housing 11, a cover 12, and a seal member 13. In the casing 10, an internal space is formed by the housing 11 and the cover 12, and the internal space accommodates the terminals 20, the ends of the electrical wires 30, the flexible conductors 40, and the connecting members 50.

The housing 11 is formed of a resin material. The housing 11 includes first accommodation portions 11*a* which accommodate the terminals 20 and a second accommodation portion 11*b* which accommodate the ends of the electrical wires 30, the flexible conductors 40, and the connecting members 50. The housing 11 is formed by integrally molding the first accommodation portions 11*a* and the second accommodation portion 11*b*. In the housing 11, the first accommodation portions 11*a* protrude from the second accommodation portion 11*b*. The protruding direction is coincident with an insertion direction of the terminal 20, which is described below.

The first accommodation portion 11*a* is formed in a cylindrical shape, and a space formed therein is used as a terminal accommodation chamber $\mathbf{11}a_1$. The terminal 20 is inserted into the terminal accommodation chamber $\mathbf{11}a_1$ along the axial direction of the cylindrical shape, and is held in the terminal accommodation chamber $\mathbf{11}a_1$. The insertion direction of the terminal 20 toward the terminal accommodation chamber $\mathbf{11}a_1$ is coincident with an insertion direction of the terminal 20 toward the housing 11 and an insertion direction of the terminal 20 toward a mating terminal (not illustrated) {that is, an insertion direction of the connector 1 toward a mating connector (not illustrated)}. The illustrated terminal 20 is, as described later, a female terminal having a first connection portion (terminal connection portion) 21 formed in a cylindrical shape. Therefore, in the illustration, the first accommodation portion 11*a* is formed in a cylindrical shape, and the terminal accommodation chamber $\mathbf{11}a_1$ is formed in a columnar shape. In addition, an end portion of the first accommodation portion 11*a* on the insertion direction side is provided with an opening $\mathbf{11}a_2$ which communicates with the terminal accommodation chamber $\mathbf{11}a_1$. The opening $\mathbf{11}a_2$ is used as an insertion port through which the mating terminal (male terminal) is inserted into the terminal accommodation chamber $\mathbf{11}a_1$ when the terminal 20 and the mating terminal are connected to each other.

The illustrated connector 1 includes the two terminals 20. Therefore, the two first accommodation portions 11*a* which respectively accommodate the terminals 20 are formed in the housing 11. The two first accommodation portions 11*a* are arranged in parallel in a state in which the insertion directions of the terminals 20 are coincident with each other.

In the second accommodation portion 11*b*, L-shaped accommodation chambers $\mathbf{11}b_1$ and fixing member accommodation chambers $\mathbf{11}b_2$ are formed.

The L-shaped accommodation chamber $\mathbf{11}b_1$ is a space which accommodates the end of the electrical wire 30, the flexible conductor 40, and the connecting member 50, and forms a substantially L-shaped space when viewed in a direction perpendicular to the insertion direction. As the terminal 20 is inserted into the housing 11, the end of the electrical wire 30, the flexible conductor 40, and the connecting member 50 are inserted into the L-shaped accommodation chamber $\mathbf{11}b_1$ along the insertion direction of the terminal 20. The L-shaped accommodation chamber $\mathbf{11}b_1$ is mainly divided into a first accommodation chamber $\mathbf{11}b_{11}$ which accommodates the end of the electrical wire 30, the flexible conductor 40, and an electrical connection portion 51 of the connecting member 50, which will be described later, and a second accommodation chamber $\mathbf{11}b_{12}$ which accommodates a fixing portion 52 of the connecting member 50, which will be described later.

The first accommodation chamber $\mathbf{11}b_{11}$ is disposed on a side opposite to the mating terminal side with respect to the first accommodation portion 11*a*, and is allowed to communicate with an end face of the terminal accommodation chamber $\mathbf{11}a_1$ on the side opposite to the mating terminal side. The first accommodation chamber $\mathbf{11}b_{11}$ is formed in a substantially cubic shape, and an end face of six faces thereof on the insertion direction side is allowed to communicate with the end face of the terminal accommodation chamber $\mathbf{11}a_1$ on the above-mentioned opposite side. The terminal 20 is inserted into the terminal accommodation chamber $\mathbf{11}a_1$ through the first accommodation chamber $\mathbf{11}b_{11}$ when accommodated in the housing 11. That is, the first accommodation chamber $\mathbf{11}b_{11}$ forms an insertion path of the terminal 20 when the terminal 20 is accommodated in the terminal accommodation chamber $\mathbf{11}a_1$. As the terminal 20 is accommodated in the terminal accommodation chamber $\mathbf{11}a_1$, the end of the electrical wire 30, the flexible conductor 40, and the electrical connection portion 51 of the connecting member 50 are accommodated in the first accommodation chamber $\mathbf{11}b_{11}$.

The second accommodation chamber $\mathbf{11}b_{12}$ is disposed in an end portion of the first accommodation chamber $\mathbf{11}b_{11}$ on the side opposite to the mating terminal side so that the first accommodation chamber $\mathbf{11}b_{11}$ and the second accommodation chamber $\mathbf{11}b_{12}$ form a substantially L-shaped space. The second accommodation chamber $\mathbf{11}b_{12}$ has a substantially cubic shape and is formed to have a shorter length in the insertion direction than that of the first accommodation chamber $\mathbf{11}b_{11}$. As the terminal 20 is accommodated in the terminal accommodation chamber $\mathbf{11}a_1$, the fixing portion 52 of the connecting member 50 is accommodated in the second accommodation chamber $\mathbf{11}b_{12}$.

The fixing member accommodation chamber $\mathbf{11}b_2$ is a space which accommodates a first fixing member 81. The first fixing member 81 is a member which is used by forming a pair with a second fixing member 82. The first fixing member 81 and the second fixing member 82 are used to fix the fixing portion 52 of the connecting member 50 to the housing 11. One of the first fixing member 81 and the second fixing member 82 is a female screw member formed as a female screw, and the other is a male screw member formed as a male screw. In the illustration, the first fixing member 81 is the female screw member, and the second fixing member 82 is the male screw member. A nut as the first fixing member 81 is fitted and fixed to the fixing member accommodation chamber 11$b_2$. When the terminal 20 is accommodated in the terminal accommodation chamber 11$a_1$, a columnar space (a space in which the female screw portion is formed) inside the first fixing member 81 and a through-hole 52*a* of the fixing portion 52 are disposed concentrically with each other, and an exposed surface of the first fixing member 81 exposed from the fixing member accommodation chamber 11$b_2$ abuts the fixing portion 52. Therefore, as the second fixing member 82 is screwed to the first fixing member 81, the connecting member 50 is fixed to the housing 11.

The illustrated connector 1 includes the two terminals 20 as described above and thus includes the two electrical wires with the two terminals. Therefore, in the second accommodation portion 11*b*, the L-shaped accommodation chamber 11$b_1$ and the fixing member accommodation chamber 11$b_2$ are formed for each of the electrical wires with the terminals. Here, so as not to allow the electrical wires with the terminals to come in electrical contact with each other, the second accommodation portion 11*b* may be provided with a partition wall between the L-shaped accommodation chamber 11$b_1$ and the fixing member accommodation chamber 11$b_2$ for one electrical wire with the terminal and the L-shaped accommodation chamber 11$b_1$ and the fixing member accommodation chamber 11$b_2$ for the other electrical wire with the terminal.

Here, an end portion of the second accommodation portion 11*b* on the side opposite to the mating terminal side (the first accommodation portion 11*a* side) includes an opening (in the illustration, an opening formed in a substantially rectangular shape) 11$b_3$. The opening 11$b_3$ communicates with an end face of the L-shaped accommodation chamber 11$b_1$ (the first accommodation chamber 11$b_{11}$ and the second accommodation chamber 11$b_{12}$) on the side opposite to the mating terminal side.

The opening 11$b_3$ is blocked by the cover 12. The cover 12 includes a primary portion 12*a* which is formed as a substantially rectangular flat plate that is greater than the opening 11$b_3$, a first frame portion 12*b* which protrudes from the primary portion 12*a* in the insertion direction, and a second frame portion 12*c* which protrudes from the primary portion 12*a* in the direction opposite to the insertion direction. The cover 12 is formed of a resin material. The cover 12 is formed by integrally molding the primary portion 12*a*, the first frame portion 12*b*, and the second frame portion 12*c*.

A wall surface of the peripheral edge of the primary portion 12*a* on the insertion direction side is allowed to abut an annular end face (an end face forming the opening 11$b_3$) of the second accommodation portion 11*b*.

The first frame portion 12*b* is inserted into the second accommodation portion 11*b*. The first frame portion 12*b* has an outer peripheral surface provided at a predetermined interval from an inner peripheral surface of the second accommodation portion 11*b*, which forms the opening 11$b_3$, over the entire surface. The seal member 13 having an annular shape is interposed between the outer peripheral surface of the first frame portion 12*b* and the inner peripheral surface of the second accommodation portion 11*b*. The seal member 13 is a member for preventing the infiltration of liquid, dust, or the like into the inside of the housing 11 from between the second accommodation portion 11*b* and the cover 12. Therefore, the seal member 13 is formed to be thicker than the interval between the outer peripheral surface and the inner peripheral surface.

The second frame portion 12*c* accommodates a rectangular or plate-like electrical wire holding member 61 in the electrical wire holding mechanism 60, which will be described later. Here, the electrical wire holding member 61 is formed of an elastic material, which will be described later. The second frame portion 12*c* has a substantially cubic accommodation space, which is smaller than the rectangular shape of the electrical wire holding member 61, in order to prevent the infiltration of liquid, dust, or the like into the primary portion 12*a* side from between the second frame portion 12*c* and the electrical wire holding member 61. Therefore, the electrical wire holding member 61 is fitted in the second frame portion 12*c*.

Through-holes 12*d* through which the electrical wires 30 are inserted in the insertion direction are formed in the primary portion 12*a*, the first frame portion 12*b*, and the second frame portion 12*c*. Therefore, the electrical wire 30 is drawn from the housing 11 in a direction opposite to the insertion direction. The through-hole 12*d* is formed for each of the electrical wires 30.

In the casing 10 having the above-described configuration, the annular seal member 91 is mounted in the boundary portion between the first accommodation portion 11*a* of the housing 11 and the second accommodation portion 11*b*. The seal member 91 is for preventing the infiltration of liquid, dust, or the like between the connector 1 and the mating connector.

The terminal 20 is a terminal fitting formed by forming a conductive metal material in a predetermined male type shape or a female type shape. The terminal 20 includes the first connection portion 21 as a terminal connection portion, which is electrically connected to the mating terminal in a connection state between the connector 1 and the mating connector (in a connector connection state), and a second connection portion 22 as an electrical wire connection portion, which is electrically connected to the electrical wire 30 side. The terminal 20 may also be a male terminal or a female terminal. In the illustration, the first connection portion 21 is formed in a cylindrical female type shape. In addition, the illustrated second connection portion 22 is formed to be crimped and fixed by caulking to the inserted electrical wire 30 side (specifically, the flexible conductor 40). In the terminal 20, an insertion direction of the first connection portion 21 toward the mating terminal and an insertion direction of the electrical wire 30 side toward the second connection portion 22 are coincident with each other.

The electrical wire 30 includes a core 31 as a conductor, and a sheath member 32 which covers the core 31. The electrical wire 30 allows the core 31 to be exposed at the tip end on the insertion direction side. The electrical wire 30 is prepared for each of the terminals 20. In the first accommodation chamber 11$b_{11}$ described above, the end of the electrical wire 30 including the exposed portion of the core 31 is accommodated. The flexible conductor 40 and the connecting member 50 are interposed between the electrical wire 30 and the terminal 20. In the first accommodation chamber 11$b_{11}$, as described later, the terminal 20, the flexible conductor 40, the connecting member 50, and the electrical wire 30 are arranged in this order. That is, the electrical wire 30 is disposed on the side opposite to the terminal 20 and the flexible conductor 40 with respect to the connecting member 50. In the electrical wire 30, the core 31 at the tip end is electrically connected to the connecting member 50. In addition, the electrical wire 30 is drawn from the first accommodation chamber 11$b_{11}$ in the direction opposite to the insertion direction.

The flexible conductor 40 is formed of a conductor having flexibility, that is, a member having flexibility and conductivity. Flexibility refers to a property having lower rigidity than those of, for example, the terminal 20, the core 31 of the electrical wire 30, and the connecting member 50. The illustrated flexible conductor 40 is obtained by forming braid having conductivity in a predetermined shape. Braid is formed by braiding a plurality of strands into a mesh shape. The flexible conductor 40 is disposed on the side opposite to the mating terminal with respect to the terminal 20. An end of the flexible conductor 40 is electrically connected to the second connection portion 22 of the terminal 20, and the other end thereof is electrically connected to the connecting member 50. The flexible conductor 40 includes a first connection portion 41 as a terminal side connection portion, which is electrically connected to the second connection portion 22, and a second connection portion 42 as a connecting member side connection portion, which is electrically connected to the connecting member 50. In the flexible conductor 40, the first connection portion 41 is crimped and fixed to the second connection portion 22, and the second connection portion 42 is crimped and fixed to the electrical connection portion 51 of the connecting member 50. Furthermore, the flexible conductor 40 has a bent portion 43, which is bent in a direction intersecting the insertion direction, between the first connection portion 41 and the second connection portion 42. Here, for example, the flexible conductor 40, which has the bent portion 43 and the first and second connection portions 41 and 42 provided at both ends thereof, is formed by bending the center portion of flat plate-like braid in an arc shape. The flexible conductor 40 is prepared for each of the terminals 20.

The connecting member 50 is formed of a conductive metal material. The connecting member 50 is a conductor which is electrically connected to the core 31 of the electrical wire 30 and the flexible conductor 40, and allows the core 31 and the flexible conductor 40 to be electrically connected to each other. The connecting member 50 is disposed between the electrical wire 30 and the flexible conductor 40 (that is, on the side opposite to the terminal 20 with respect to the flexible conductor 40, in other words, on the terminal 20 side of the electrical wire 30). The connecting member 50 is prepared for each of the terminals 20.

The connecting member 50 includes an electrical wire connection portion, which is electrically connected to the core 31 of the electrical wire 30, and a flexible conductor connecting portion, which is electrically connected to the flexible conductor 40. In the connecting member 50, the electrical wire connection portion and the flexible conductor connecting portion may be separately provided. However, in the illustrated connecting member 50, the electrical connection portion 51 which is used as both the electrical wire connection portion and the flexible conductor connecting portion. The electrical connection portion 51 is a portion which electrically connects the core 31 of the electrical wire 30 to the flexible conductor 40. The core 31 at the tip end of the electrical wire 30 is inserted into the electrical connection portion 51 in the insertion direction, and the second connection portion 42 of the flexible conductor 40 is inserted thereinto in the direction opposite to the insertion direction. The electrical connection portion 51 is formed to be crimped and fixed by collectively caulking to the inserted second connection portion 42 and the core 31.

The connecting member 50 is fixed to the inside of the housing 11. The connecting member 50 includes the fixing portion 52 which protrudes in the direction intersecting the insertion direction. The fixing portion 52 protrudes from an end portion of the electrical connection portion 51 on the mating terminal side. The fixing portion 52 is provided with the through-hole 52*a* which is disposed concentrically with the first fixing member 81 in the housing 11. As described above, the connecting member 50 is screwed to the inside of the housing 11 through the through-hole 52*a* of the fixing portion 52.

The electrical wire holding mechanism 60 holds the electrical wire 30 on the drawing direction side of the electrical wire 30 with respect to the portion connected to the connecting member 50. The electrical wire holding mechanism 60 is disposed to be prevented from moving relative to the terminal 20. The electrical wire holding mechanism 60 is provided on at least one of the inside and the outside of the casing 10, and is fixed to the casing 10. In the illustration, the electrical wire holding mechanism 60 is provided on the outside of the casing 10. The electrical wire holding mechanism 60 includes the electrical wire holding member 61 and a rear holder 62.

The electrical wire holding member 61 is disposed on the inside of the second frame portion 12*c* in the cover 12 of the casing 10 as described above, and holds the electrical wire 30 on the inside thereof. The electrical wire holding member 61 is formed of an elastic material in a rectangular and plate-like shape. The electrical wire holding member 61 is provided with a through-hole 61*a* which allows the electrical wire 30 to be inserted therethrough and held. The through-hole 61*a* is disposed concentrically with the through-hole 12*d* of the cover 12. The through-hole 61*a* covers the outer peripheral surface of the sheath member 32 of the electrical wire 30 and has a smaller inner diameter than the outer diameter of the sheath member 32. Therefore, the through-hole 61*a* can press the outer peripheral surface of the inserted sheath member 32 with repulsive force and holds the electrical wire 30 with the pressing force. The through-hole 61*a* can prevent the infiltration of liquid, dust, or the like between the through-hole 61*a* and the electrical wire 30 by the pressing force. The through-hole 61*a* is formed for each of the electrical wires 30.

The rear holder 62 includes a blocking portion 62*a* which blocks the opening of the second frame portion 12*c* which accommodates the electrical wire holding member 61, and a wall portion 62*b* which protrudes from the peripheral edge of the blocking portion 62*a* in the insertion direction and covers the outer peripheral surface of the second frame portion 12*c*. In the rear holder 62, the blocking portion 62*a* and the wall portion 62*b* are formed of a resin material integrally with each other. The blocking portion 62*a* is provided with a through-hole $\mathbf{62}a_1$ through which the electrical wire 30 is inserted. The through-hole $\mathbf{62}a_1$ is disposed concentrically with the through-hole 61*a* of the electrical wire holding member 61. The through-hole $\mathbf{62}a_1$ is formed for each of the electrical wires 30. The rear holder 62 includes locking portions 62*c* at two points, and is locked, for example, to the housing 11 by the locking portions 62*c*.

The shield structure 70 covers the casing 10 from the outside and prevents intrusion of radio waves from the outside to the inside of the casing 10. The illustrated shield structure 70 also covers electrical wire holding mechanism 60 from the outside in addition to the casing 10. The shield structure 70 includes a first shell 71, a second shell 72, and the braid 73.

The first and second shells 71 and 72 are fitted to each other to form a cylindrical body which covers the housing 11 from the outside. Each of the first and second shells 71 and 72 corresponds to a halved section of the cylindrical body excluding an end portion thereof on the mating terminal side. The first shell 71 includes one divided portion (first divided portion) 71*a* divided from the cylindrical body, and a first annular portion 71*b* which is the end portion on the mating terminal side. On the other hand, the second shell 72 includes the other divided portion (second divided portion) 72*a* divided from the cylindrical body. The first and second shells 71 and 72 constitute the cylindrical body by fitting the first divided portion 71*a* and the second divided portion 72*a*. The first and second shells 71 and 72 are formed of a conductive metal material. An annular space into which the mating connector is inserted is formed between the inner peripheral surface of the first annular portion 71*b* and the outer peripheral surface of the first accommodation portion 11*a* of the housing 11.

Here, the first shell 71 is provided with through-holes 71*c* (in the illustration, two through-holes 71*c*). In addition, the housing 11 is provided with female screw portions 11*c* which are concentric with the through-holes 71*c*. Male screw members 83 are inserted through the through-holes 71*c* and are screwed to the female screw portions 11*c*. That is, the first shell 71 is screwed to the housing 11 via the through-holes 71*c*.

The cylindrical body which is a body made by fitting the first and second shells 71 and 72 to each other covers the casing 10 on the mating terminal side of the housing 11. Therefore, in the illustration, the braid 73 having conductivity is provided to cover the remaining section of the casing 10 which is not covered with the cylindrical body (the side opposite to the mating terminal side), the cover 12, and the electrical wire holding mechanism 60 from the outside. The braid 73 is formed in a cylindrical shape to cover them from the outside. The mating terminal side of the braid 73 covers a second annular portion 74 of the cylindrical body constituted by the first and second shells 71 and 72, and is fastened to the second annular portion 74 by a metallic band 84.

In the connector 1 having the above-described configuration, since the flexible conductor 40 is interposed between the terminal 20 and the electrical wire 30, in a case where a force occurs in the electrical wire 30, the force is absorbed by the flexible conductor 40, and the transmission of the force from the electrical wire 30 to the terminal 20 is prevented. Particularly, in the flexible conductor 40, the bent portion 43 which is formed between the first connection portion 41 (the portion connected to the terminal 20) and the second connection portion 42 (the portion connected to the connecting member 50 and the electrical wire 30). Therefore, in the connector 1, the force absorbency of the flexible conductor 40 becomes higher than that of a flexible conductor which does not include the bent portion 43. Therefore, when a force occurs in the electrical wire 30, an effect of preventing the transmission of the force from the electrical wire 30 to the terminal 20 is highly achieved.

Furthermore, in the connector 1, since the connecting member 50 which connects the electrical wire 30 to the flexible conductor 40 is fixed to the housing 11, the amount of the force that occurs in the electrical wire 30 and is transmitted to the flexible conductor 40 can be reduced. Therefore, even from this point of view, when a force occurs in the electrical wire 30, the connector 1 can prevent the transmission of the force from the electrical wire 30 to the terminal 20.

Moreover, in the connector 1, since the portion of the electrical wire 30 on the drawing direction side of the electrical wire 30 with respect to the portion connected to the connecting member 50 and the flexible conductor 40 is held by the electrical wire holding mechanism 60, the amount of force that occurs in the electrical wire 30 and is transmitted to the connection portion can be reduced. Therefore, even from this point of view, when a force occurs in the electrical wire 30, the connector 1 can prevent the transmission of the force from the electrical wire 30 to the terminal 20.

As described above, in the connector 1, since the flexible conductor 40 is interposed between the terminal 20 and the electrical wire 30 and the connecting member 50 is interposed between the electrical wire 30 and the flexible conductor 40, the transmission of a force that occurs in the electrical wire 30 to the terminal 20 can be prevented even in a straight type connector. Therefore, the connector 1 can also prevent the transmission of the force to the contact portion between the terminal 20 and the mating terminal. Accordingly, the connector 1 can prevent the occurrence of failure of the contact between the terminal 20 and the mating terminal. Particularly, the illustrated flexible conductor 40 includes the bent portion 43 between the first connection portion 41 and the second connection portion 42. Consequently, in the connector 1, a force transmitted from the electrical wire 30 to the flexible conductor 40 is absorbed by the bent portion 43, and the transmission of the force to the terminal 20 is more significantly prevented.

In addition, in the connector 1, since the connecting member 50 is fixed to the housing 11, the force that occurs in the electrical wire 30 can be allowed to be released to the housing 11 via the connecting member 50. Even from this point of view, the transmission of the force to the terminal 20 can be prevented. Therefore, in the connector 1, the occurrence of failure of the contact between the terminal 20 and the mating terminal can be further prevented. In addition, in the connector 1, since the portion of the electrical wire 30 on the drawing direction side of the electrical wire 30 with respect to the portion connected to the connecting member 50 is held by the electrical wire holding mechanism 60, the force that occurs in the electrical wire 30 is less likely to be transmitted to the flexible conductor 40 or the connecting member 50 prior to the electrical wire holding mechanism 60. Therefore, in the connector 1, the transmission of the force that occurs in the electrical wire 30 to the terminal 20 is further prevented. Therefore, the occurrence of failure of the contact between the terminal 20 and the mating terminal can be further prevented.

In addition, in the flexible conductor 40, before the connecting member 50 is fixed to the housing 11, the positional relationship between the first connection portion 41 and the second connection portion 42 can be shifted with respect to the bent portion 43 as the boundary. Therefore, the bent portion 43 can absorb the design tolerances of various constituent components such as the terminal 20 and the positional shifts of the constituent components due to assembly tolerances, and thus the through-hole 52*a* of the fixing portion 52 of the connecting member 50 and the screw portion of the first fixing member 81 can be allowed to concentrically approach each other. Therefore, the connector 1 can be assembled even when the management of the tolerances of the constituent components is not stricter than that in the related art, and thus the margin of increase in cost can be suppressed.

In the connector according to the present invention, since the flexible conductor is interposed between the terminal and the electrical wire and the connecting member is interposed between the electrical wire and the flexible conductor, even in the straight type, the transmission of a force that occurs in the electrical wire to the terminal can be prevented. In addition, in the connector, since the connecting member is fixed to the housing, the force that occurs in the electrical wire can be released to the housing via the connecting member. Even from this point of view, the transmission of the force to the terminal can be prevented.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a casing having insulation properties;

a terminal which is accommodated and held on an inside of the casing and is connected to a mating terminal in a connector connection state;

a flexible conductor which is a conductor having flexibility, is disposed inside the casing and on a side opposite to the mating terminal with respect to the terminal, and is electrically connected to the terminal;

a connecting member which is a conductor fixed to the casing in the casing, is disposed on a side opposite to the terminal with respect to the flexible conductor, and is electrically connected to the flexible conductor; and an electrical wire which is disposed on a side opposite to the terminal with respect to the connecting member, is electrically connected to the connecting member, and is drawn from the inside of the casing in a direction opposite to an insertion direction of the terminal toward the mating terminal, wherein the connecting member includes an electrical connection portion which electrically connects the flexible conductor to a core of the electrical wire, the flexible conductor is inserted into the electrical connection portion in a direction opposite to the insertion direction, and the core of the electrical wire is inserted into the electrical connection portion in the insertion direction.

2. The connector according to claim 1, further comprising:

a shield structure which covers the casing from an outside and is configured to prevent intrusion of radio waves from the outside into the inside of the casing.

3. The connector according to claim 1, wherein the connecting member includes a fixing portion which protrudes in a direction intersecting the insertion direction, and is fixed to the casing via the fixing portion.

4. The connector according to claim 3, wherein the flexible conductor includes a bent portion which is bent in the direction intersecting the insertion direction.

5. The connector according to claim 3, further comprising:

an electrical wire holding mechanism which holds a portion of the electrical wire on the drawing direction side with respect to a portion of the electrical wire connected to the connecting member.

6. The connector according to claim 3, further comprising:

a shield structure which covers the casing from an outside and is configured to prevent intrusion of radio waves from the outside into the inside of the casing.

7. The connector according to claim 1, wherein the flexible conductor includes a bent portion which is bent in the direction intersecting the insertion direction.

8. The connector according to claim 7, further comprising:

an electrical wire holding mechanism which holds a portion of the electrical wire on the drawing direction side with respect to a portion of the electrical wire connected to the connecting member.

9. The connector according to claim 7, further comprising:

a shield structure which covers the casing from an outside and is configured to prevent intrusion of radio waves from the outside into the inside of the casing.

10. The connector according to claim 1, further comprising:

an electrical wire holding mechanism which holds a portion of the electrical wire on the drawing direction side with respect to a portion of the electrical wire connected to the connecting member.

11. The connector according to claim 10, further comprising:

a shield structure which covers the casing from an outside and is configured to prevent intrusion of radio waves from the outside into the inside of the casing.

* * * * *